US007102576B2

(12) United States Patent
Kim

(10) Patent No.: US 7,102,576 B2
(45) Date of Patent: Sep. 5, 2006

(54) ANTENNA FOR WIRELESS COMMUNICATION

(76) Inventor: Young Joon Kim, 101-803 Anam Apt., 2-4 Myungrium-Dong, Chongro-Ku 110-522, Seoul (KR)

( * ) Notice: Subject to any disclaimer, the term of this patent is extended or adjusted under 35 U.S.C. 154(b) by 0 days.

(21) Appl. No.: 10/477,182

(22) PCT Filed: May 13, 2002

(86) PCT No.: PCT/KR02/00885

§ 371 (c)(1),
(2), (4) Date: Nov. 10, 2003

(87) PCT Pub. No.: WO03/038944

PCT Pub. Date: May 8, 2003

(65) Prior Publication Data

US 2004/0189535 A1 Sep. 30, 2004

(30) Foreign Application Priority Data

Oct. 31, 2001 (KR) ..... 2001-67318

(51) Int. Cl.
*H01Q 1/24* (2006.01)
*H01Q 1/42* (2006.01)

(52) U.S. Cl. ..... 343/702; 343/715; 343/872

(58) Field of Classification Search ..... 343/702, 343/715, 725, 790, 791, 872, 895, 900, 752
See application file for complete search history.

(56) References Cited

U.S. PATENT DOCUMENTS

| | | | | | |
|---|---|---|---|---|---|
| 2,533,078 | A * | 12/1950 | Woodward, Jr. | ..... | 343/790 |
| 3,315,264 | A * | 4/1967 | Brueckmann | ..... | 343/791 |
| 3,750,181 | A * | 7/1973 | Kuecken | ..... | 343/790 |
| 5,995,065 | A * | 11/1999 | Kitchener et al. | ..... | 343/895 |
| 5,999,132 | A * | 12/1999 | Kitchener et al. | ..... | 343/702 |
| 6,037,907 | A * | 3/2000 | Ha et al. | ..... | 343/752 |
| 6,052,090 | A * | 4/2000 | Simmons et al. | ..... | 343/702 |
| 6,215,451 | B1 * | 4/2001 | Hadzoglou | ..... | 343/715 |
| 6,222,494 | B1 * | 4/2001 | Erkocevic | ..... | 343/790 |
| 6,392,599 | B1 * | 5/2002 | Ganeshmoorthy et al. | .. | 343/700 MS |
| 6,452,555 | B1 * | 9/2002 | Chang et al. | ..... | 343/702 |
| 6,556,171 | B1 * | 4/2003 | Gillon et al. | ..... | 343/702 |
| 6,661,383 | B1 * | 12/2003 | Sakurai et al. | ..... | 343/702 |

* cited by examiner

*Primary Examiner*—Tan Ho
(74) *Attorney, Agent, or Firm*—Antonelli, Terry, Stout and Kraus, LLP.

(57) ABSTRACT

The invention is an antenna for a wireless communication, comprising a cylindrical holder including a closed end and a side portion; and a rod including one end connected to the closed end of the holder.

25 Claims, 12 Drawing Sheets

ANTENNA FOR WIRELESS COMMUNICATION

This application is a 371 of PCT/KR02/00885 filed on May 13, 2001.

TECHNICAL FIELD

The present invention relates to an antenna for a wireless communication, and more particularly, to an nX antenna for a wireless communication terminal having a small size, a high power communication capability, good frequency and gain characteristics, and suitable for a wireless communication antenna. Further, this invention relates to an nX antenna for a wireless communication terminal, which is suitable for an armored and built-in antenna of a mobile communication terminal, etc.

BACKGROUND ART

Through the present application, "nX antenna" is named from a type of an electrical charge flow depending on the structural characteristics of antennas disclosed by the present invention.

Due to rapid developments in the analog and digital communication technologies worldwide at the present, mobile communication services, such as cellular, PCS, GSM, PHS, the former Iridium service using an artificial satellite, IMT2000 service, etc., are being provided. Also, wireless communication is being used in various fields, such as wireless LAN, radios, wireless communication between apparatuses positioned within a local area, and wireless communication fields are being widely spread.

For instance, the mobile communication terminal antenna mainly uses a nondirectional retractable antenna owing to requirements of bi-directional communications are possible and it is easy to carry the antenna. Antennas of terminals that are being sold are a combination type in which an antenna suitable for a signal standby state, and an antenna suitable for telephoning state are combined, and antennas capable of transmitting and receiving linear polarization signals easily are used.

The antenna type, which protrudes upward from the terminal, mainly employs a combination type in which a spring shaped helical antenna extends and a monopole shaped whip antenna, which extends upward to enhance communication quality, are combined. In other words, in the mobile terminals, such as mobile phones, radios, PCS, etc., for performing wireless communication between moving terminals, or between a moving terminal and a fixed place, the antennas use a combination of a whip antenna and a helical antenna.

FIG. 1 is a schematic view of a conventional helical-whip combination type antenna. With reference to FIG. 1, the conventional helical-whip combination type antenna is described. The basic structure includes a helical antenna 2 and a whip antenna 3. The helical antenna 2 has a spiral conductor of a length of approximately $\lambda/4$. The whip antenna has a monopole shape. In a signal standby state or when the surrounding environment is good, the helical antenna 2 alone operates, and at a place where the electromagnetic wave environment is bad, the two antennas 2 and 3 operate at the same time in a state where the whip antenna 3 extends from a main body 1. The antennas are classified depending on positions of the helical antenna 2, and there are many modifications depending on the feed and combination of the two antennas. Antennas for mobile communication terminals, having a structure in which the helical antenna 2 is coupled to one end of the whip antenna 3, are being used as representative antennas for foreign PCS terminal products and local products. Representative of these antennas are products made by Allgon company in Sweden, which manufactures antennas. A structure, in which the helical antenna is coupled to the main body of the terminal, has a lower feeding point of the helical antenna and the whip antenna connected to the same metal connector 4. Motorola, Inc. manufactured an antenna having the same basic structure as the product of Allgon Company but used a different feeding method, and used the antenna in some terminal models. In an early stage, Korean cellular terminal models mostly used products of Allgon Company.

However, since this conventional mobile communication antenna is made as a structure protruding from the terminal, the antenna may be broken by an external force. Also, in a case when a user moves while putting the terminal in a pocket, the antenna becomes caught by a portion of the pocket causing an inconvenience in the use of the terminal.

Also, since the antenna has a minimum size due to the frequencies used characteristic in the above structure, although the terminal size may decrease, the antenna size may not decrease. Also, the area occupied by the antenna becomes larger.

Further, owing to the limitation in the performance of the antenna, the conventional antenna has the largest disadvantage involving communication quality, such as noise, cut off in calling, etc.

FIGS. 2A and 2B are sectional views of improved antennas in accordance with a conventional art. In order to overcome the aforesaid disadvantages, proposed conventional built-in antennas 10 and 20 for a mobile phone, as shown in FIGS. 2A and 2B, include, respectively, first body parts 11 and 21, second body parts 12 and 22, spaces 13 and 23 and antenna rods 14 and 24. The first body parts 11 and 21 and the second body parts 12 and 22 are made of a conductor, and have sealed upper faces and side faces and openings without a lower face. Diameters and lengths of the first body parts 11 and 21 and the second body parts 12 and 22 are decided depending on transmission and reception frequency band and their gains. The antenna rods 14 and 24 are made of a conductor, and are inwardly coupled to the upper faces of the first body parts 11 and 21 and the second body parts 12 and 22 to be connected to each other and fixed. The spacers 13 and 23 are made of nonconductor, and are coupled to the openings of the first body parts 11 and 21 and the second body parts 12 and 22 to maintain intervals between the first body part 11 and the second body part 12 and between the first body part 21 and the second body part 22. The antennas can be set by finely controlling the spacing between the first body part 11 and the second body part 12 and between the first body part 21 and the second body part 22, where the spacers 13 and 23 are positioned.

Here, the conventional dipole antenna includes an anode and a cathode. Generally, grounding of the substrate itself or a cathode pattern formed on the substrate is used as the cathode, and an antenna structure itself is used as the anode. In describing the present invention, the anode is referred to and the antenna, and descriptions of the matching circuit and other circuits are omitted.

The antennas 10 and 20 are installed at the outside of the substrate. An antenna connector is electrically connected to an antenna circuit part on the substrate, and is installed on the substrate. In the dipole antenna, the antennas 10 and 20 are used as the anode, and a circuit substrate is used as the cathode. Instead of the circuit substrate, a cathode separately formed on the substrate can be used. This antenna is made such that it is located within the case of the mobile phone. The cathode associated with the anode of antennas 10 and 20, is a conductive pattern or an antenna structure having the same structure as the anode can be used.

Thus, in the antenna structure including the first body part 11 and 21, the second body parts 12 and 22, the spacers 13 and 23 and the antenna rods 14 and 24, phase inversion is repeated by an electric flow pattern on the surface and thus resonance is generated, so that a desired gain and frequency characteristic can be obtained by using an antenna having a short length in a structure and appearance.

These antennas can be installed at any position out of the left side, right side, upper side and lower side. The cathode can be formed in a conductive pattern on the substrate to be matched with the anode. Two antennas having the same structure can be installed and connected respectively to the cathode and the anode. The two antennas can be installed in parallel to each other, or installed separately from each other in vertical direction and horizontal direction.

Then, in the foregoing antenna structure, when the two body parts are coupled such that their grooves face with each other, if a spacer of a nonconductor is formed as an interval maintaining hole and the antenna rod is coupled to both ends of the body parts using a screw or a stepped portion, the number of the elements becomes large. Since the antenna rod should be made longer to be coupled to the inside of the groove, the volume of the structure becomes large, increasing the use of raw material, weight, assembly time increases, workability is lowered, and manufacturing cost is increased.

Also, in the antenna structure, since the antenna is installed in a state in which the both ends are closed, there exists a drawback in which application width is limited in a structure connecting and installing the antenna to the circuit part of the substrate.

DETAILED DESCRIPTION OF THE INVENTION

The present invention enhances communication quality by making an antenna for a mobile communication small in size and light in weight, and enhancing receiving sensitivity.

The invention lengthens a surface length of an antenna into which electric current flows while shortening the appearance of length of the antenna.

According to a first aspect of the invention, an antenna for a wireless communication, comprises: a holder part of a cylinder shape with one end and side portion being closed; and a main rod part with one end connected to the closed end of the holder part. The antenna may further comprise one or more auxiliary rod parts connected in series to the main rod part. The main rod part is elongated and shaped as a stick, a coil, a flat plate, and a board bent in a zigzag pattern. The auxiliary rod part has one or more shapes selected from a group including a stick, a coil, a flat plate, and a board shape bent in a zigzag pattern, and if the auxiliary rod part has two or more shapes selected from the group, the selected two are connected to each other in series. The antenna further comprises connection terminals for extracting different signals of a predetermined frequency band, the connection terminals being formed at a position where the rod part are connected with each other. The holder part, the main rod part, and the auxiliary rod part are plated. The main rod part may be coupled to an inner portion or an outer portion of the closed end of the holder part. If the main rod part is coupled to the inner portion of the closed end of the holder part, the main rod part is separated from an inner wall of the side portion of the holder part, and the main rod part is longer ihan the holder part. The holder part may be a cylinder, a polygonal cylinder, or a wrinkled tube. Also, the holder part may be a hemisphere or a cap with a hollow inside. The holder part, the main rod part, and the auxiliary rod part are plated. The holder part and the main rod part are separately manufactured, the holder part has a hole formed at the closed one end, the main rod part has a stepped portion formed at one end thereof, and the main rod part is inserted into the hole of the holder part to assemble the antenna.

To accomplish the above objects, according to a second aspect of the invention, a multi-stage antenna for a wireless communication, comprises: a holder part of a cylindrical shape with one end and a side portion being closed; and a main rod part with one end connected to the closed one end of the holder part, wherein the antennas are connected with each other in series such that another end of the main rod part in one of the antennas is coupled to the closed end of the main rod part in another antenna adjacent to the one antenna. The multi-stage antenna further comprises one or more auxiliary rod parts connected in series to the main rod part of the final stage antenna.

According to a third aspect of the invention, a two stage antenna for a wireless communication, comprises: a first holder part of a cylindrical shape with one end and side portion being closed; a second holder part of a cylindrical shape with one end and side portion being closed; a first main rod part with one end being connected to the closed of the first holder part, so that the first main rod part is electrically connected with the first holder part; a second main rod part with one end connected to a closed of the second holder part, so that the second main rod part is electrically connected with the second holder part; and one or more auxiliary rod parts are connected in series between the first main rod part and the second main rod part.

According to a fourth aspect of the invention, a composite antenna for a wireless communication, comprises: a main wireless communication antenna manufactured according to the first aspect of the invention; one or more auxiliary wireless communication antennas manufactured according to the first aspect of the invention; and a flat plate-shaped connection rod part with one face connected in series to the main rod part of the main wireless communication antenna and another face has a stick part for connection, the stick part being connected to the other face of the connection rod part, wherein the main rod parts of the respective auxiliary wireless communication antennas are connected in series to the one face of the connection rod part, and are connected to the connection rod part in parallel with the main wireless communication antenna. The auxiliary wireless communication antennas are connected to the connection rod part. The composite antenna further comprises an auxiliary rod part connected in series to one end of the stick part of the connection rod part. The auxiliary rod parts are connected in series with each other, and connection terminals for extracting different signals of a predetermined frequency band are formed at a position where the auxiliary rod parts are connected with each other.

In the composite wireless communication antenna, the main wireless communication antenna and the auxiliary wireless communication antennas are coupled and manufactured in a package, the connection rod part and the auxiliary rod parts are respectively and separately manufactured in a package, and the main wireless communication antenna, the auxiliary wireless communication antennas, the connection rod parts and the auxiliary rod parts are fitted in a connector of a corresponding socket and are assembled.

The holder part of the invention has a structure which lengthens an electrical path along which electric current flows while decreasing the appearance of length of the antenna. In order to lengthen the surface length, the holder part can be made in a wrinkled shape. Thus, in the wireless communication antenna in accordance with the invention, the electrical conductive length is lengthened, a resonance frequency is generated and an antenna characteristic is enhanced while electric flow passes through the rod part, the inside of the groove of the holder part and the outer surface of the holder part. As a result, the antenna can be made to have a small size and have a small appearance of length. Also, the resonance frequency characteristic is enhanced, so that a high power characteristic is obtained. Further, in the antenna of the invention, phase inversions of electromagnetic waves are performed differently depending on the connection position of the holder part, the rod part, and the multi-stage rod part. Around a center portion of cross points of the phases, since the inverted phase forms the alphabet letter "X", the number of times (n) of the letter "X" increases by constituting the rod part in a multi-stage or in a multi-stage wireless communication antenna. Accordingly, in the present invention, an electrical flow having an nX pattern can be generated, and thus the antenna is named "nX antenna".

With the present invention the connection for connecting the antenna including the holder part and the rod part with an antenna circuit part of a substrate is provided by directly welding the end portion of the holder part, the rod part or the coil part to the substrate, or by a connector for inserting and thus connecting the end portion of the holder part, the rod part or the coil part to the substrate.

Also, the nX antenna of the invention can form the cathode using a conductive pattern formed on the substrate. The conductive pattern can have various shapes. Preferably, the conductive pattern is made in a shape having the same shape as the section of the nX antenna, thereby enhancing a frequency matching characteristic of the antenna serving as the anode, and the conductive pattern serving as the cathode.

Further, the nX antenna of the invention can be used in applications having various frequency bands, such as PCS, DCS, GPS, etc. This becomes possible by constituting the rod part in a multi-stage configuration, designing a matching point for deciding the antenna length depending on the frequency characteristic at an arbitrary position, and connecting the connector. By connecting a matching circuit matched with a frequency band with each of the connectors and selecting the matching circuit, one antenna can be applied in various frequency bans.

DESCRIPTION OF REFERENCE NUMERALS IN MAIN PARTS OF THE DRAWINGS

Figure 1:
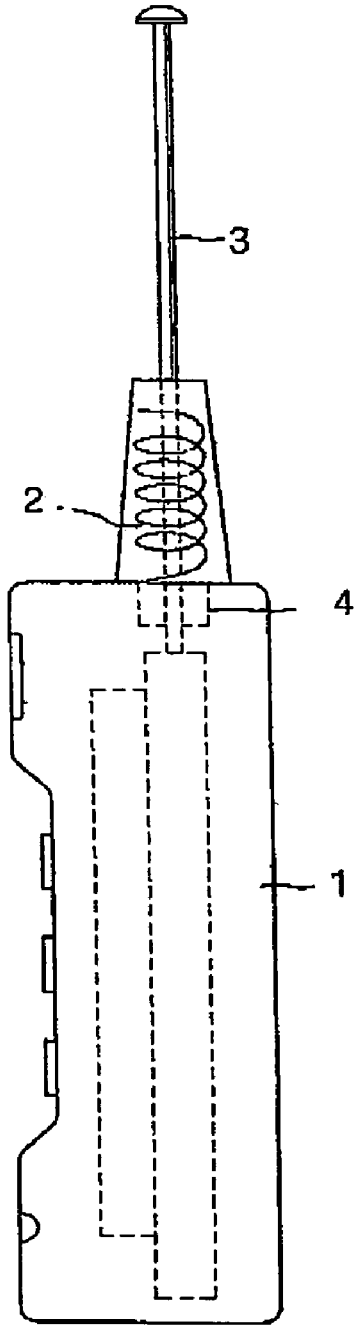
FIG. 1 (PRIOR ART)
FIG. 1 is a schematic view of a conventional helical-whip combination type antenna.
Figure 2A:
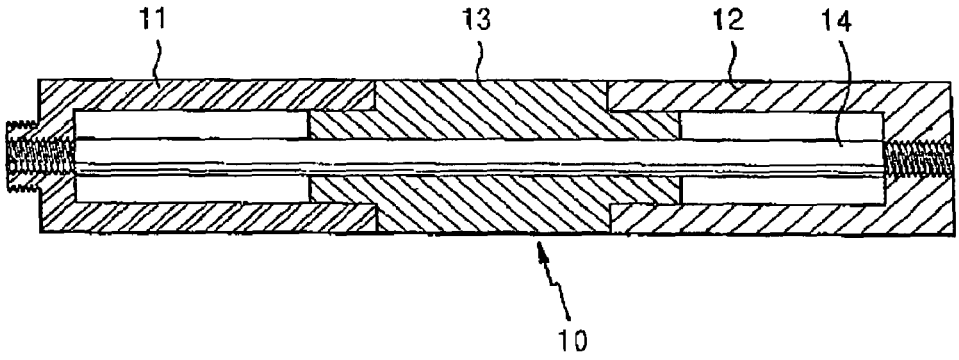
FIG. 2A (PRIOR ART)
FIGS. 2A and 2B are sectional views of improved antennas in accordance with a conventional art.
Figure 2B:
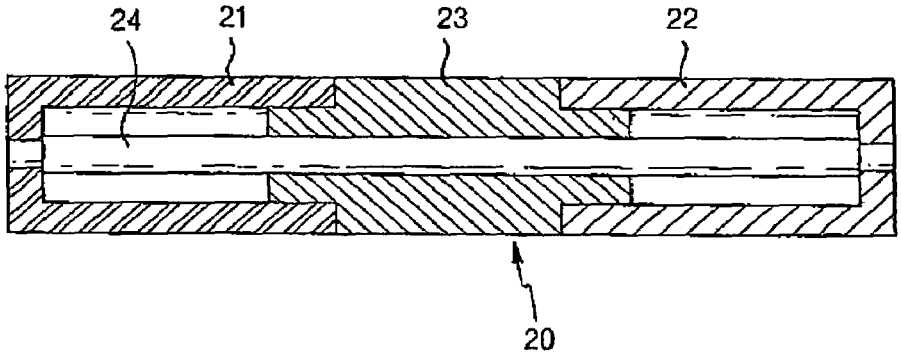
FIG. 2B (PRIOR ART)

1: Body part of telephone
2: Helical antenna
3: Whip antenna
4: Metal connector
10, 20: Conventional antenna
11, 21: $1^{st}$ body part
12, 22: $2^{nd}$ body part
13, 23: Spacer
14, 24: Rod
111, 121, 131, 141, 151, 153, 161, 163, 171, 173, 181, 191, 211, 231, 251, 261, 281: Holding part
112, 122, 132, 142, 152, 154, 162, 164, 172, 174, 182, 192, 212, 232, 252, 282: Elongated rod part
123, 165, 175, 183, 194, 262, 264: Coiled rod part
133: Zigzag rod part
143, 184, 193, 195, 213, 233, 253, 263: Plate type rod part
210, 230: Main antenna
220, 240: Auxiliary antenna
P1, P2, P3, 284: Matching point
265, 266, 267: Matching circuit
268: Selection circuit
271: Case
272: Insulator resin
273: Coil
274: Elastic connector
285: Substrate
283: Auxiliary rod part formed as circuit pattern

DETAILED DESCRIPTION OF THE PREFERRED EMBODIMENTS

Hereinafter, preferred embodiments of the present invention are described in detail with reference to the accompanying drawings.

Figure 3A:
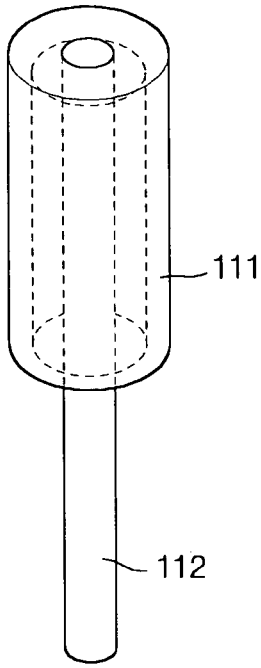
FIG. 3A is a perspective view of an nX antenna in accordance with a first embodiment of the present invention.
Figure 3B:
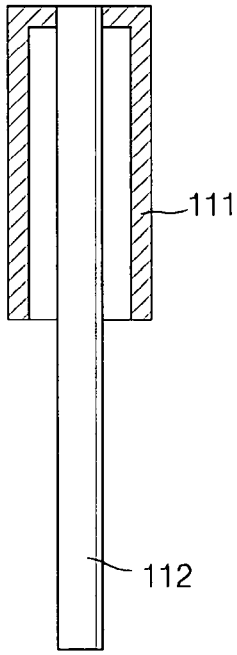
FIG. 3B is a sectional view of the nX antenna in accordance with the first embodiment of the present invention.

FIG. 3A is a perspective view of an nX antenna in accordance with a first embodiment of the present invention, and FIG. 3B is a sectional view of the nX antenna in accordance with the first embodiment of the present invention. With reference to FIGS. 3A and 3B, the first embodiment is described in detail.

An elongated rod 112 is connected to one end (upper side) of a holder part 111. The elongated rod part 112 is separated from the side inner wall of the holder part. The stick type rod part 112 is longer than the holder part 111. So, the elongated rod part 112 has an appearance extending outside the holder part by a predetermined length. Thus, the elongated rod part 112 is positioned within the holder part 111, thereby enhancing inner and outer resonance effects of electromagnetic waves, and allowing an overall length of the antenna to be shortened. Further, a connection terminal is formed in the elongated type rod part 112 to thereby connect an electromagnetic wave having a necessary wavelength to a circuit.

Figure 3C:
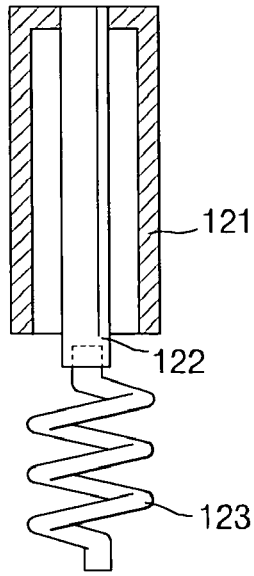
FIG. 3C is a sectional view of an nX antenna in accordance with a second embodiment of the present invention.

FIG. 3C is a sectional view of an nX antenna in accordance with a second embodiment of the present invention. With reference to FIG. 3C, the second embodiment is described in detail.

The antenna of the second embodiment includes a holding part 121 and an elongated rod part 122 basically having the same structure as that of the first embodiment. In addition, the antenna of the second embodiment has a coiled part 123 connected to the elongated rod part 122. This composite type antenna has a structure in which the holding part 121, the elongated rod part 122 and the coiled part 123 are connected. The coiled part 123 is connected to the elongated rod part 122 to lengthen an overall electrical length of the antenna while maintaining a real length of the antenna, when it is necessary to lengthen the antenna due to the frequency characteristic, that is, when the antenna is used in a low frequency band. Further, one or more connection terminals may be formed in the elongated rod part 122 and the coiled part 123 to connect electromagnetic waves having a necessary wavelength to a circuit. Furthermore, one or more arbitrary rod parts, such as an elongated rod part, a coiled part, a plate part, a zigzag part, etc., are connected to the coiled part 123, and one or more connection terminals are connected to the arbitrary part, thereby connecting an electromagnetic wave having a necessary wavelength to a circuit.

Figure 3D:
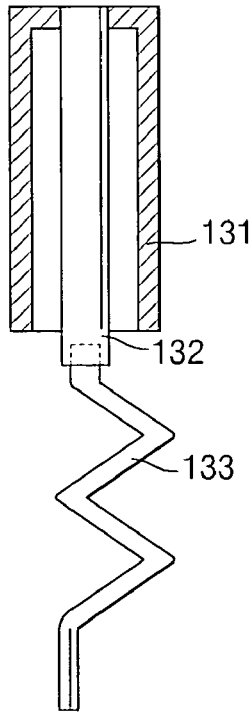
FIG. 3D is a sectional view of an nX antenna in accordance with a third embodiment of the present invention.

FIG. 3D is a sectional view of an nX antenna in accordance with a third embodiment of the present invention. With reference to FIG. 3, the third embodiment is described in detail.

In the antenna of the third embodiment, a zigzag part 133, having a shape in which a board is bent in a zigzag manner, is further connected to an elongated rod part 132 of the basic structure shown in the first embodiment. The zigzag part 133 has connection terminals at both ends thereof. This composite type antenna has a shape in which a holder 131, the elongated rod part 132 and the zigzag part 133 are connected. The zigzag type part 133 is connected to the elongated rod part 132 is to lengthen an overall electrical length of the antenna while, to maintaining a real length of the antenna, in a case when it is necessary to lengthen the antenna due to the frequency characteristic, that is, when the antenna is used in a low frequency band. The zigzag part 133 of the third embodiment has the same function as the coiled part 123 of the second embodiment. Further, one or more connection terminals may be formed in the elongated rod part 132 and the zigzag part 133 to connect electromagnetic waves having a necessary wavelength to a circuit. Furthermore, one or more arbitrary parts, such as an elongated part, a coiled part, a plate part, a zigzag part, etc., are connected to the zigzag part 133, and one or more connection terminals are connected to the arbitrary part, thereby being capable of connecting electromagnetic waves having a necessary wavelength to a circuit.

Figure 3E:
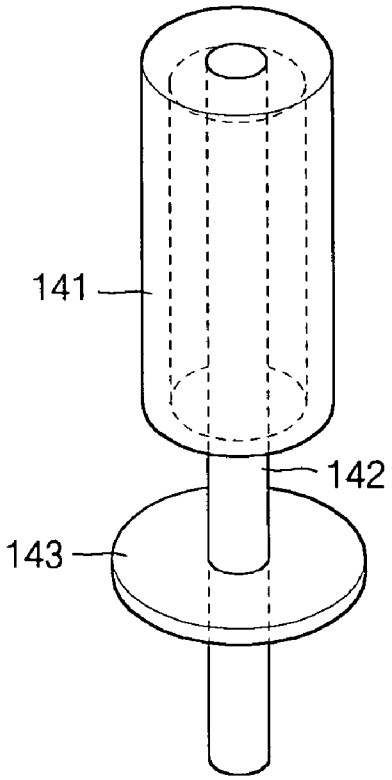
FIG. 3E is a perspective view of an nX antenna in accordance with a fourth embodiment of the present invention.

FIG. 3E is a perspective view of an nX antenna in accordance with a fourth embodiment of the present invention. With reference to FIG. 3E, the fourth embodiment of the invention is described in detail.

In the antenna of the fourth embodiment, a plate part 143 is further connected to an elongated rod part 142 of the basic structure shown in the first embodiment. This composite type antenna has a shape in which a holder part 141, the elongated part 142 and the plate type rod part 143 are connected. The plate type part 143 is connected to the elongated rod part 142 to lengthen an overall electrical length of the antenna while maintaining a real length of the antenna, when it is necessary to lengthen the antenna due to the frequency characteristic, that is, when the antenna is used in a low frequency band. The plate type part 143 of the fourth embodiment has the same function as the coiled part 123 of the second embodiment and the zigzag part 133 of the third embodiment. Further, one or more connection terminals may be formed in the elongated rod part 142 and the plate type part 143 to connect electromagnetic waves having a necessary wavelength to a circuit. Furthermore, one or more arbitrary rod parts, such as an elongated rod part, a coiled rod part, a plate part, a zigzag part, etc., are connected to the plate type rod part 143, and one or more connection terminals are connected to the arbitrary rod part, thereby capable of connecting electromagnetic waves having a necessary wavelength to a circuit.

Figure 3F:
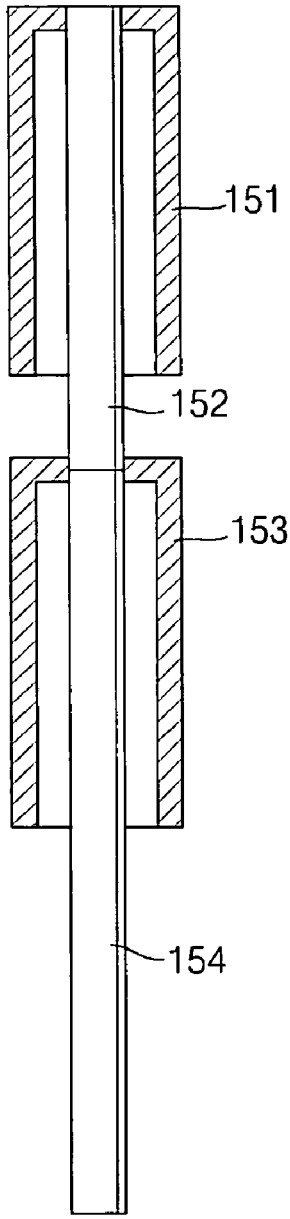
FIG. 3F is a sectional view of an nX antenna in accordance with a fifth embodiment of the present invention.

FIG. 3F is a sectional view of an nX antenna in accordance with a fifth embodiment of the present invention. With reference to FIG. 3E, the fourth embodiment of the invention is described in detail.

In case where it is requested that the antenna length be lengthened in the basic structures shown in FIGS. 3A and 3B according to a characteristic of a corresponding frequency which is used, a first antenna having the same basic structure as that of the first embodiment, that is, having a first holder 151 and a first elongated rod part 152, and a second antenna having the same basic structure, that is, having a second holder 153 and a second elongated rod part 154, are connected with each other, in which one end of the first elongated rod part 152 is connected to an outer face of an upper side of the second holder 153, thereby providing an antenna with two stages. By using this coupling technique, it is also possible to provide an antenna with multiple stages. Further, one or more connection terminals may be formed in the first elongated part 152 and the second elongated rod part 154, thereby providing capability of connecting electromagnetic waves having a necessary wavelength to a circuit. Furthermore, one or more arbitrary parts, such as an elongated rod part, a coiled part, a plate part, a zigzag part, etc., are connected to the second elongated rod part 154, and one or more connection terminals are connected to the arbitrary part, thereby providing capability of connecting electromagnetic waves having a necessary wavelength to a circuit.

Figure 3G:
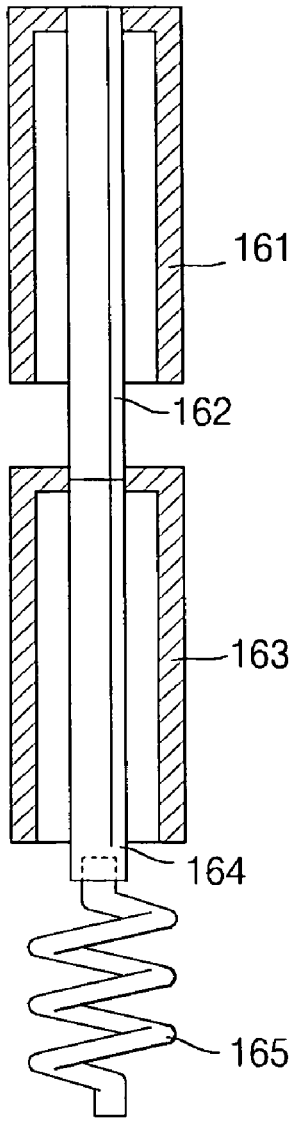
FIG. 3G is a sectional view of an nX antenna in accordance with a sixth embodiment of the present invention.

FIG. 3G is a sectional view of an nX antenna in accordance with a sixth embodiment of the present invention.

With reference to FIG. 3G, the sixth embodiment of the invention is described in detail.

The antenna of the sixth embodiment has structure in which the second embodiment and the fifth embodiment are coupled. Using the same structure as the fifth embodiment, including a first holder 161, a second holder 163, a first elongated rod part 162 and a second elongated rod part 164, and a coiled part 165 are further connected to the second elongated rod part 164. In other words, the coiled part 165 is further added to the multiple structures, thereby providing capability to a multiple composite structure. The coiled part 165 is connected to the elongated rod part 164 to lengthen an overall electrical length of the antenna while maintaining a real shaped length of the antenna, in a case where it is necessary to lengthen the antenna due to the frequency characteristic, that is, when the antenna is used in a low frequency band. Furthermore, one or more connection terminals may be formed in the first elongated rod part 162, the second elongated rod part 164 and the coiled part 165, thereby providing capability of connecting electromagnetic waves having a necessary wavelength to a circuit. Furthermore, one or more arbitrary parts, such as an elongated rod part, a coiled part, a plate part, a zigzag part, etc., are connected to the coiled type rod part 165, and one or more connection terminals are connected to the arbitrary part, thereby providing capability of connecting an electromagnetic wave having a necessary wavelength to a circuit.

As a modified example of the sixth embodiment, an antenna in which the fifth embodiment and the third embodiment are coupled, or an antenna in which the fourth embodiment and the third embodiment are coupled, can be made like the above description.

Figure 3H:
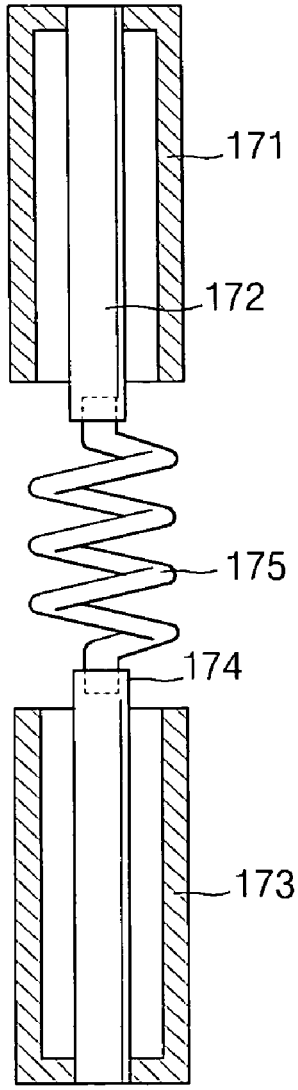
FIG. 3H is a sectional view of an nX antenna in accordance with a seventh embodiment of the present invention.

FIG. 3H is a sectional view of an nX antenna in accordance with a seventh embodiment of the present invention. With reference to FIG. 3H, the seventh embodiment of the invention is described in detail.

The antenna of the seventh embodiment is made with an elongated rod part 172 of a first antenna including a holder 171 and the elongated rod part 172 having the same structure than the first embodiment, and an elongated rod part 174 of a second antenna including a holder 173 and the elongated rod part 174 having the same structure than the first embodiment facing opposite each other, and by connecting a coiled part 175 between the opposed elongated rod parts 172 and 174. At this time, instead of the coiled part 175, a plate type rod part having a predetermined diameter, any one out of a elongated rod part and a zigzag part in which a board is bent in a zigzag manner is used, thereby providing capability of constituting an antenna to perform the function of the coiled part 175. Furthermore, one or more connection terminals may be formed in the elongated rod parts 172 and 174, and the coiled 175, thereby providing capability of connecting an electromagnetic wave having a necessary wavelength to a circuit. Furthermore, one or more parts, such as an elongated rod part, a coiled part, a plate part, a zigzag part in which a board is bent in a zigzag, etc., are connected in series, and the serially connected parts can be used instead of the coiled part 175. Of course, one or more connection terminals are connected to the parts, thereby providing capability of connecting an electromagnetic wave having a necessary wavelength to a circuit.

Figure 3I:
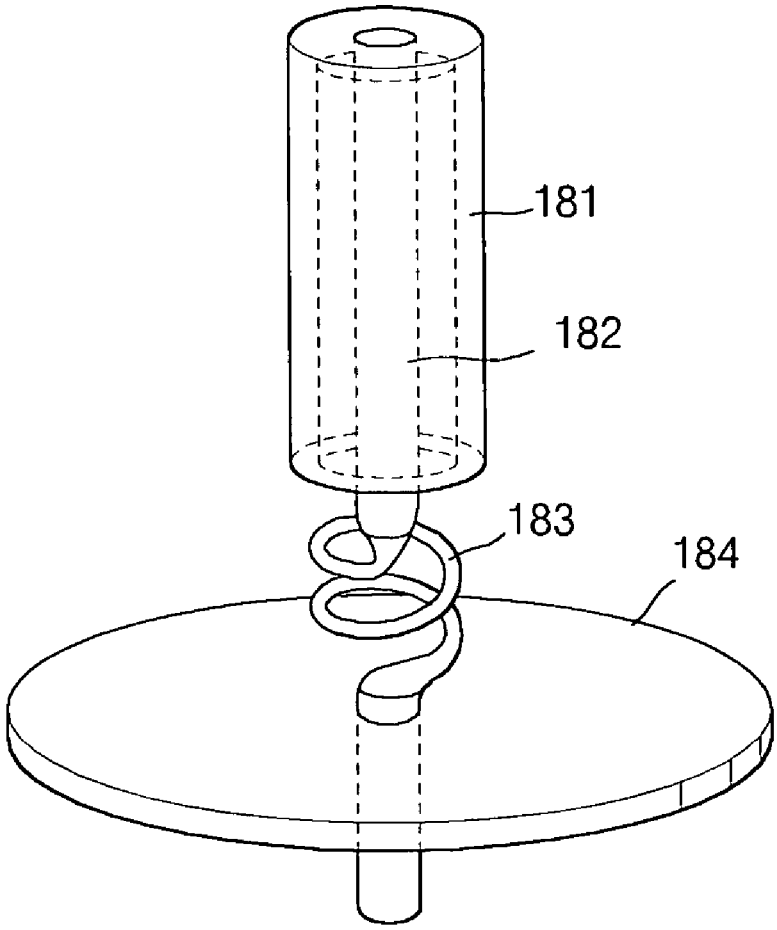
FIG. 3I is a perspective view of an nX antenna in accordance with an eighth embodiment of the present invention.

FIG. 3I is a perspective view of an nX antenna in accordance with an eighth embodiment of the present invention. With reference to FIG. 3I, the eighth embodiment of the invention is described in detail.

Using same structure as the second embodiment, including a holder 181 and a coiled part 183, a plate part 184 is further connected to the coiled part 183. This composite structure antenna has a structure in which the holder 181, an elongated rod part 182 and the coiled part 183 are connected. The coiled part 183 is connected to the elongated rod part 182 and the plate type rod part 184 is connected to the coiled part 183 to lengthen an overall electrical length of the antenna while maintaining a real physical length of the antenna, when it is necessary to electrically lengthen the antenna due to the frequency characteristic, i.e., when the antenna is used in a low frequency band. Further, one or more connection terminals may be formed in the elongated rod part 182, the coiled part 183 and the plate part 184 to connect an electromagnetic wave having a necessary wavelength to a circuit. Furthermore, one or more arbitrary parts, such as an elongated rod part, a coiled part, a plate part, a zigzag rod part, etc., are connected to the plate part 183, and one or more connection terminals are connected to the arbitrary part, thereby providing capability of connecting electromagnetic waves having a necessary wavelength to a circuit.

Figure 3J:
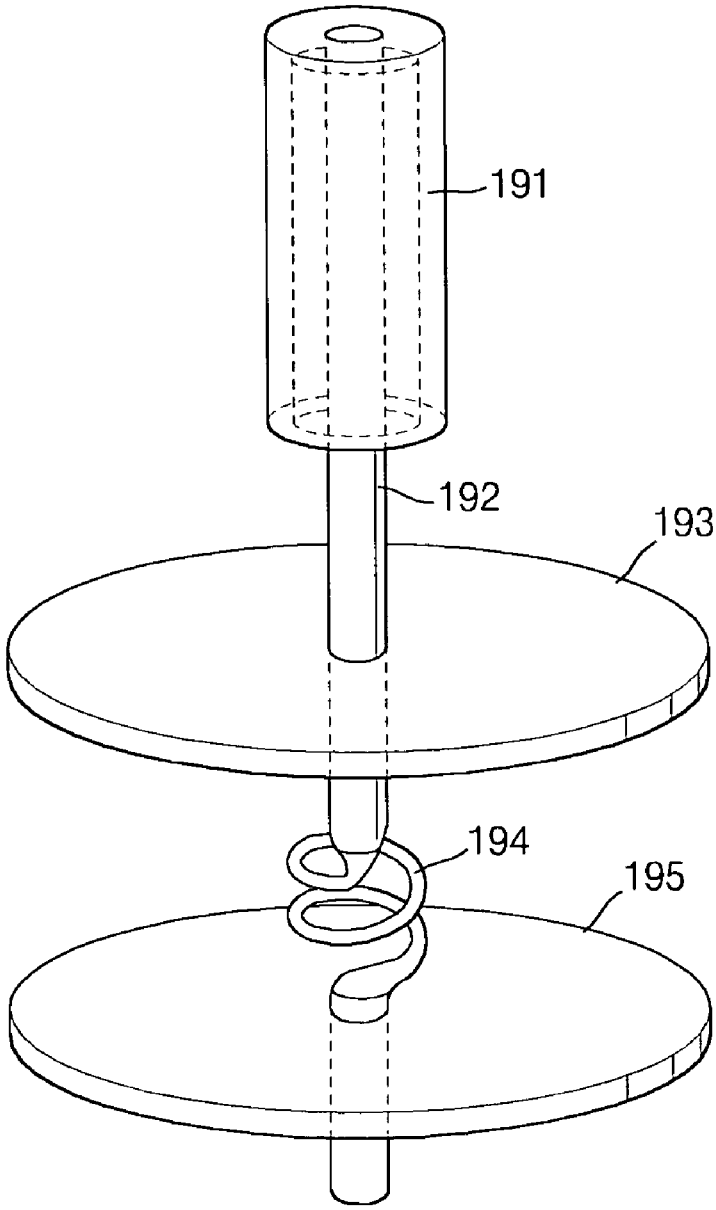
FIG. 3J is a perspective view of an nX antenna in accordance with a ninth embodiment of the present invention.

FIG. 3J is a perspective view of an nX antenna in accordance with a ninth embodiment of the present invention. With reference to FIG. 31, the ninth embodiment of the invention is described in detail.

The present ninth embodiment may be referred to as a modified example of the fourth embodiment. Using same structure as the second embodiment, including a holder 191 and a plate part 193, a coiled part 194 is further connected to the plate part 193, and another plate part 195 is also connected to the coiled type rod part 194. This composite structure antenna has a structure in which the holder 191, elongated rod part 192, the plate part 193, the coiled part 194 and the plate part 195 are connected. The plate type rod part 193 is connected to the elongated rod part 192, the coiled part 194 is connected to the plate part 193 and the plate part 195 is connected to the coiled part 194 is to lengthen an overall electrical length of the antenna while to maintain a physical shape of the antenna to not have an unappealing length, in a case where it is necessary to lengthen the antenna due to the frequency characteristic, i.e., when the antenna is used in a low frequency band. Further, one or more connection terminals may be formed in the elongated rod part 192, the plate part 193, the coiled part 194 and the plate part 195 to connect electromagnetic waves having a necessary wavelength to a circuit. Furthermore, one or more arbitrary parts, such as an elongated part, a coiled part, a plate part, a zigzag part, etc., are connected to the plate type rod part 195, and one or more connection terminals are connected to the arbitrary rod part, thereby providing capability of connecting electromagnetic waves having a necessary wavelength to a circuit.

The ninth embodiment has the structure in which the plate parts 193 and 195 are constituted in two-stages and the coiled part 194 is added between the plate parts 193 and 195. Instead of the coiled part 194, one or more arbitrary parts, such as an elongated part, a coiled part, a plate part, a zigzag part, etc., are used, to constitute the antenna. Of course, the plate type part can be also constituted in two or more stages, and one or more the coiled parts can be inserted.

Figure 3K:
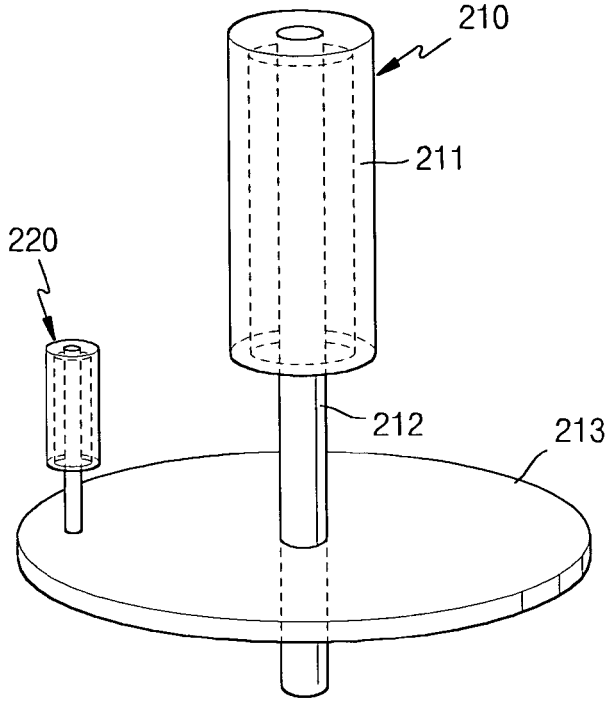
FIG. 3K is a perspective view of an nX antenna in accordance with a tenth embodiment of the present invention.

FIG. 3K is a perspective view of an nX antenna in accordance with a tenth embodiment of the present invention. With reference to FIG. 3K, the tenth embodiment of the invention is described in detail.

The tenth embodiment corresponds to a structure in which the first embodiment and the fourth embodiment are coupled. An antenna 210 having the same structure as the fourth embodiment, including a holder 211, an elongated part 212 and a plate part 213, is used as the main antenna 210. An antenna 220 having the same structure as the first embodiment is used as the auxiliary antenna 220. In this embodiment, an elongated rod part of the auxiliary antenna 220 is connected to an upper face of the plate type rod part 213 of the main antenna 210. The size of the plate part 213 is designed differently depending on a frequency characteristic and use thereof, and are designed considering the main antenna and the auxiliary antenna. In the case of using the plate part 213, the antenna is suitable for a high power, can be utilized as an antenna in a fixed station or a base station, and even can be applied to terminals.

One or more auxiliary antennas can be connected. In the aforementioned embodiments and examples, if the antennas have the plate part, they can be used as the main antenna. In particularly, the antennas described in the fourth, eighth and ninth embodiments are appropriate for the main antenna. Also, in the aforementioned embodiments and examples, an arbitrary antenna may be used as the auxiliary antenna.

Figure 3L:
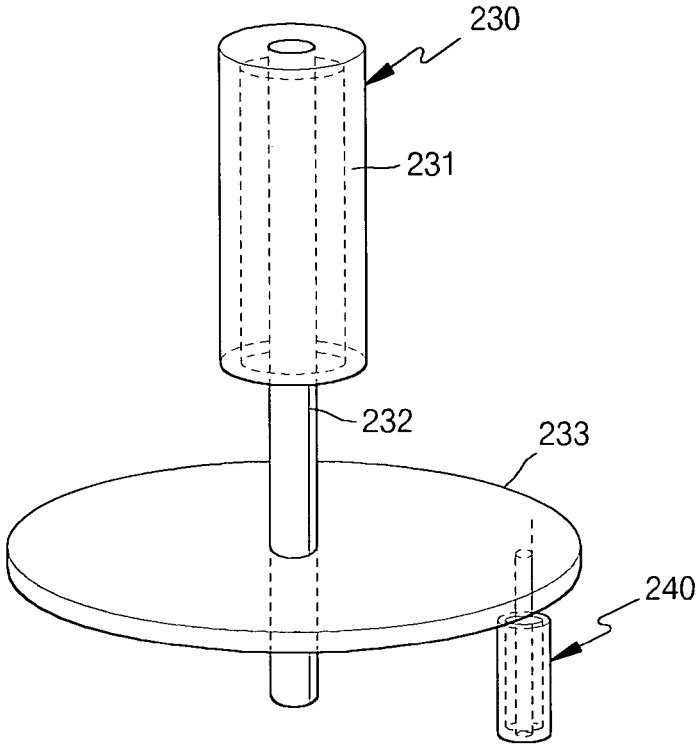
FIG. 3L is a perspective view of an nX antenna in accordance with an eleventh embodiment of the present invention.

FIG. 3L is a perspective view of an nX antenna in accordance with an eleventh embodiment of the present invention. With reference to FIG. 11, the eleventh embodiment is described in detail.

The eleventh embodiment corresponds to a structure coupled differently from the tenth embodiment in which the first embodiment and the fourth embodiment are coupled. An antenna 230 having the same structure as the fourth embodiment, including a holder 231, an elongated rod part 232 and a plate part 233 are used as the main antenna 230. An antenna 240 having the same structure as the first embodiment is used as the auxiliary antenna 240. An elongated rod part of the auxiliary antenna 240 is connected to a lower face of the plate part 233 of the main antenna 230. One or more auxiliary antennas can be connected. The size of the plate part 233 is designed differently depending on a frequency characteristic and use thereof and are designed considering the main antenna and the auxiliary antenna. In a case of using the plate part 233, the antenna is suitable for high power, application such as an antenna for a fixed station or a base station, and even can be applied to terminals.

One or more auxiliary antennas can be connected. In the aforementioned embodiments or examples, if the antenna has the plate type part, the antenna can be used as the main antenna. In particular, the antenna described in the fourth, eighth and ninth embodiments are appropriate for the main antenna. Also, in the aforementioned embodiments and the modified examples, an arbitrary antenna may be used as the auxiliary antenna.

Further, by coupling the tenth embodiment and the eleventh embodiment, the elongated rod parts of the auxiliary antennas 220 and 240 may be connected to the upper face and the lower face of the plate type rod parts 213 and 233 of the main antennas 210 and 230. One or more auxiliary antennas can be connected. Furthermore, in the aforementioned embodiments or examples, if the antennas have the plate type part, the antennas can be used as the main antenna. In particularly, the antennas described in the fourth, eighth and ninth embodiments are appropriate for the main antenna. Also, in the aforementioned embodiments and the modified examples, an arbitrary antenna may be used as the auxiliary antenna.

Figure 4A:
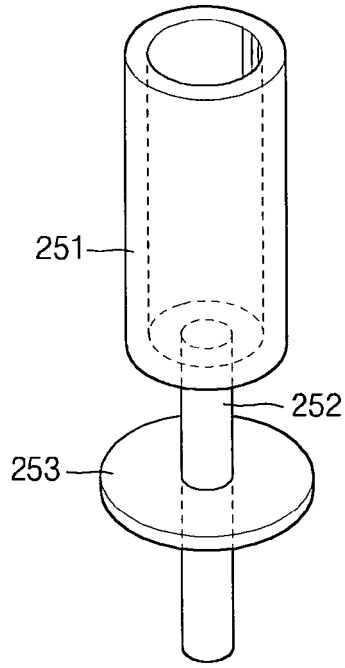
FIG. 4A is a perspective view of an nX antenna in accordance with a twelfth embodiment of the present invention.
Figure 4B:
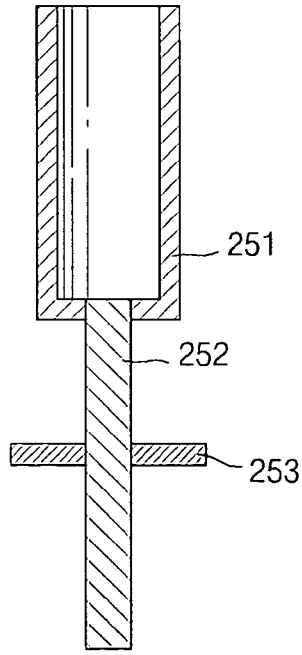
FIG. 4B is a sectional view of the nX antenna in accordance with the twelfth embodiment of the present invention.

FIG. 4A is a perspective view of an nX antenna in accordance with a twelfth embodiment of the present invention, and FIG. 4B is a sectional view of the nX antenna in accordance with the twelfth embodiment of the present invention.

The present antenna has a structure in which an elongated rod part 252 is connected to an outer face of a closed end of a holder 251 in addition to the same structure as the fourth embodiment. In this structure, diameter and length are designed to generate resonance considering frequency used for wireless transmission and receipt and gain characteristic. A plate part 253 is connected to the elongated rod part 252.

Further, by changing the connection between the closed end and the rod part from the inner face of the closed end of the holder to an outer face of the closed one end in the structures of the first embodiment to the eleventh embodiment, and modified examples thereof; modified examples can be made. Furthermore, like the twelfth embodiment and the examples thereof, the connection between the closed one end of the holder and the elongated rod part may be changed into a mixed structure in which the connection portions are positioned at an outer face of the closed one end and an inner face of the closed end.

In the aforementioned embodiments and examples thereof; the holder and the part connected to the holder can be constituted in an integral type. Each of the parts is coupled to a predetermined portion of one end of another part, and the end of the part serves as a lead, to be directly soldered to a substrate or be coupled to the substrate using a separate connector. The holder can be made in various shapes, such as a circular shape, a polygonal cylindrical shape, a wrinkled tube shape, etc. Also, the holder part can be made in a hollow hemispheric shape, or a cap shape. The plate part may be constituted to have an arc shaped wrinkle, which widens the surface area.

As exemplified and described above, the antennas of the invention are not limited to the examples shown in the drawings. The parts can be bent and inserted to be soldered as the lead, or be equipped in a connector. The holder and the parts can be installed in parallel with a substrate so as to utilize a space. Also, an installation position of the antenna can be changed. For instance, the antenna can be installed at a space formed by diagonally cutting a corner of the substrate, or at an arbitrary position.

Thus, in the nX antennas having the basic structure, a resonance frequency is generated by the holder and the part, and although not shown in the drawings, the nX antennas perform the functions as the antenna together with a cathode of a conductive pattern formed on the substrate. Thus, only by the holder and the part, the antenna can obtain the resonance characteristic, so that the electrical surface length of the antenna is lengthened more than the appearance of length of the antenna and inner resonance is generated, thereby obtaining transmission and receipt performances of high power that is enhanced to be more than general communication antennas.

Figure 5:
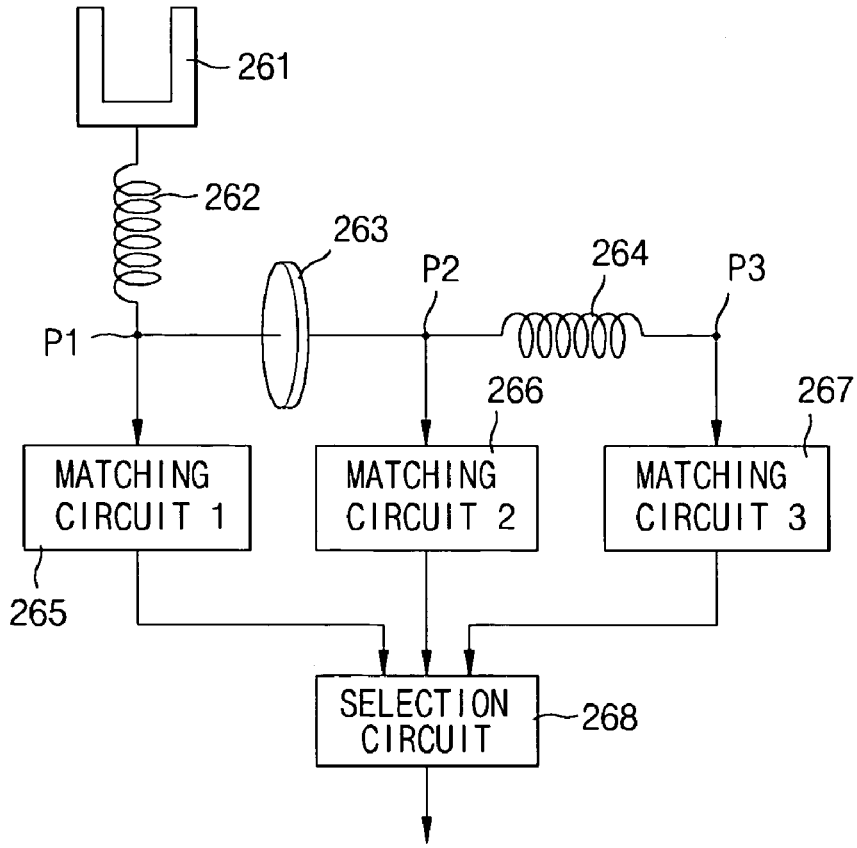
FIG. 5 is an exemplary view showing an application of the nX antenna in accordance with the present invention.

FIG. 5 is an exemplary view showing an application of the nX antenna in accordance with the present invention. With reference to FIG. 5, application examples of the nX antenna of the present invention are described.

In a case of communication means having different frequency bands, such as PCS, DCS, GPS, etc., antennas should be designed and made differently from each other. So, if a single antenna exists when designing an arbitrary wireless communication terminal, the antenna can be used in only a single frequency band. Considering this fact, the invention adds auxiliary rod parts 263 and 264 in order to extend a main rod part 262 connected to a holder part 261 of the antenna. For the auxiliary rod parts 263 and 264, the plate rod part 263 and the coiled part are selected owing to the necessity thereof matching points P1, P2 and P3 for deciding the length of the antenna depending on the frequency characteristic are designed at proper positions. Matching circuits 265, 266 and 267 suitable for respective frequency bands are connected to the respective matching points P1, P2 and P3, and a selection circuit for selecting the matching circuits 265, 266 and 267 is provided, so that one antenna can be applied to various frequency bands.

Figure 6:
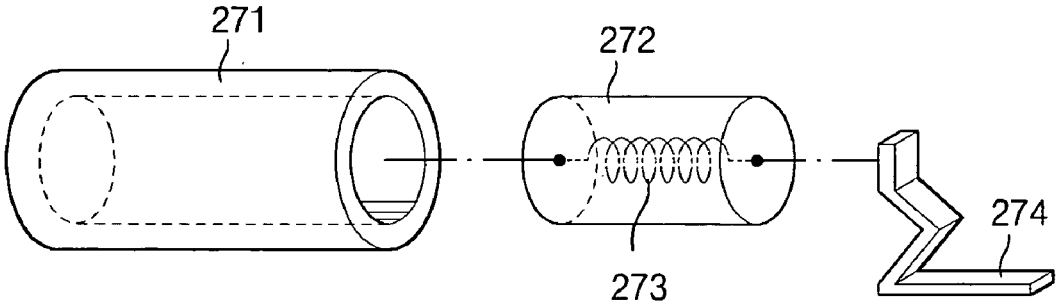
FIG. 6 is a disassembled perspective view of a coil type auxiliary rod part package in accordance with the present invention.

FIG. 6 is a disassembled perspective view of a coiled part, auxiliary package in accordance with the present invention. With reference to FIG. 6, the coiled auxiliary package structure of the nX antenna is described.

By packaging the coupling of the holder and the main part or the auxiliary parts, the assembling or structure of the antenna is simplified. FIG. 6 is one example of the packaging, and shows the structure of the coiled auxiliary part package of the nX antenna. A coil 273 is molded by an insulator resin 272 and is then get into a case 271 to protect the coil 273. This packaged coil auxiliary part is connected to a circuit by an elastic connector 274. The elastic connector 274 is made such that it is connected to both sides of the packaged coil auxiliary part and thus the coiled auxiliary rod part is fixed. In addition, various auxiliary rod parts can be packaged by the aforesaid way. Also, the holder part and the main rod part can be made in an integral structure by a method such as casting or the like. Furthermore, the holder and the main part can be separately manufactured. At this time, a coupling hole is formed in the holder and a coupling stepped portion is formed in the main part, and these two elements are coupled and assembled. The respective elements are plated to stabilize the performances of the antenna.

Also, the antenna needs means to connect to the antenna circuit, in which although not shown in the drawings, the rod is directly soldered/welded to the substrate, or is connected to the antenna circuit part using a connector. One end of the holder can be also connected using a welding or a connector. Furthermore, the holder is allowed to be insertion-fixed to the terminal case, and correspondingly a connector having elasticity is installed to fit the packaged part, thereby facilitating the antenna installation.

Figure 7:
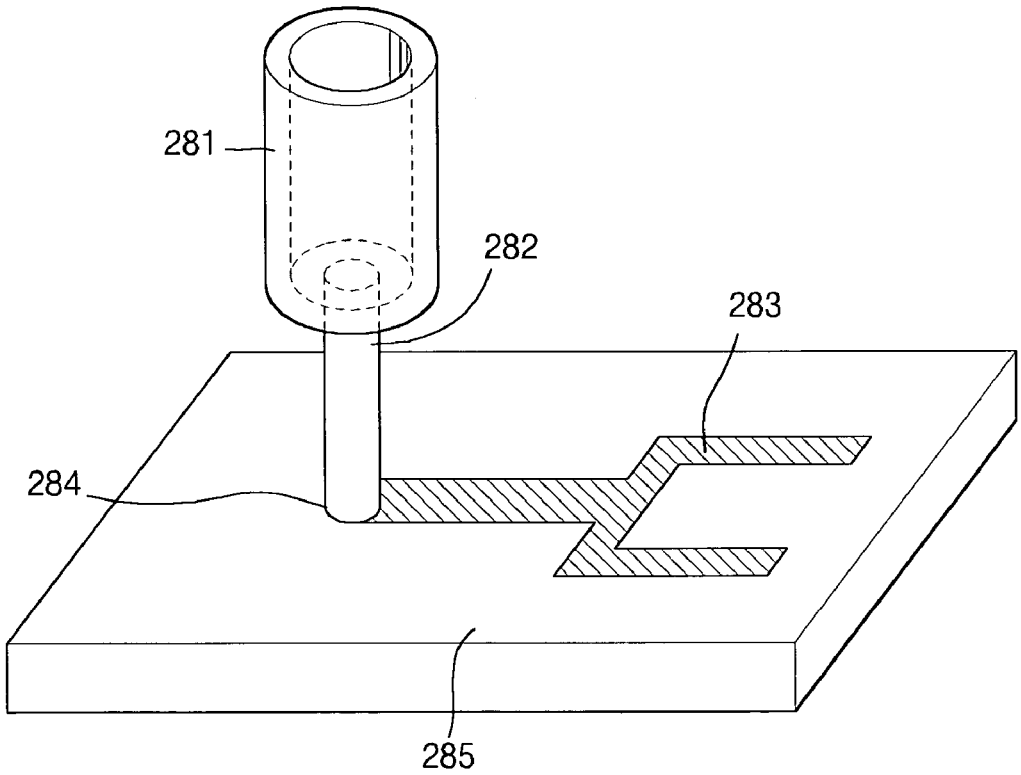
FIG. 7 is a perspective view of an nX antenna in accordance with a thirteenth embodiment of the present invention.

FIG. 7 is a perspective view of an nX antenna in accordance with a thirteenth embodiment of the present invention. With reference to FIG. 7, the thirteenth embodiment is described.

In a basic structure in which an elongated rod part 282 is connected to an outer face of a end of a holder 281, an auxiliary rod 283 formed in a circuit pattern on a substrate 285 is connected to an elongated main rod part 282. This circuit pattern, i.e., the auxiliary part 283 has the same shape as the longitudinal sectional view of the antenna in which the elongated rod part is connected to the outer face of a closed one end of the holder. A matching point 284 is defined at a position where the elongated main rod part 282 and the auxiliary part 283 are connected, a connection terminal is formed at the matching point 284, and a matching circuit (not shown) is formed at the matching point 284.

Thus, the auxiliary rod part can be made in the form of pattern on the substrate. The pattern may be Y shaped, T shaped, or the same shape as the longitudinal sectional view of the antenna in which the elongated rod part is connected to the outer face of the closed end of the holder like the thirteenth embodiment. However, the third embodiment is most preferable.

The first embodiment to the twelfth embodiment, modified examples thereof and combined examples thereof can be made like the thirteenth embodiment.

INDUSTRIAL APPLICABILITY

As described previously, the present invention is suitable for an antenna for a wireless communication having an ultra-small size and light weight, and is capable of providing an ultra small sized antenna having greatly enhanced performance compared with the conventional antenna. The present invention is suitable for a small-sized wireless communication apparatus, such as a mobile communication terminal, a wireless communication terminal for IMT2000, a wireless LAN communication terminal, etc., orienting toward small in size and light in weight. In particular, it is suitable for an ultra small sized armored and built-in type antenna, and may be applied to a wireless communications between fixed stations, and wireless communication between a fixed station and a moving station, and wireless communications between moving stations, etc.

As described above, since the invention can constitute a basic antenna only by using a hollow holder, and a part, it is possible to provide an ultra small sized antenna, and to variously change the design thereof into a multi-stage structure, a composite structure to which a coil is added, a structure to which a flat plate is added, a structure in which a main antenna and auxiliary antenna part are compositely provided on the flat plate, etc., considering use of the antenna, a frequency characteristic and so on in order to utilize a low frequency band.

The invention claimed is:

1. An antenna for a wireless communication, comprising:

a cylindrical holder including a closed end and a side portion;

a rod including one end connected to the closed end of the holder;

a flat plate having offset surfaces connected to the rod; and a card connected to the rod.

2. The antenna as claimed in claim 1, wherein the rod is elongated.

3. The antenna as claimed in claim 1, wherein the rod is bent in a zigzag manner.

4. The antenna as claimed in claim 1, comprising another rod connected in series to the rod which comprises one of an elongated rod, a coil, a flat plate, and a board bent in a zigzag manner.

5. An antenna as claimed in claim 1, wherein the rod is coupled to an inner portion of the closed end of the holder, and is spaced apart from an inner wall of the side portion of the holder.

6. An antenna as claimed in claim 1 wherein the rod is coupled to an outer face of the closed end of the holder.

7. An antenna for a wireless communication, comprising:

a cylindrical holder including a closed end and a side portion;

a rod including one end connected to the closed end of the holder;

another rod connected in series to the rod; and wherein the another rod is a pattern formed on a substrate.

8. The antenna as claimed in claim 7, wherein the holder, the rod, and the another rod are plated.

9. An antenna for a wireless communication, comprising:

a cylindrical holder including a closed end and a side portion; and a rod including one end connected to the closed end of the holder;

another rod connected in series to the rod; and connection terminals for extracting different signals of a predetermined frequency band, the connection terminals being formed at a position where the rods are connected with each other.

10. An antenna for a wireless communication, comprising:

a cylindrical holder including a closed end and a side portion;

a rod including one end connected to the closed end of the holder; and wherein the holder and the rod are separate parts, the holder has a hole formed at the closed end, the rod has a stepped portion formed at one end thereof, and the rod is inserted into the hole of the holder to assemble the antenna.

11. The antenna as claimed in claim 10, wherein the holder and the rod are separate parts, and the holder and the rod are inserted into connectors of a corresponding socket to assemble the antenna.

12. A multiple stage antenna for wireless communication each comprising:

a cylindrical holder with a closed end and a closed side portion; and a rod with one end connected to the closed end of the holder; and wherein the antennas of the multiple storage antenna are connected with each other in series so that an end of the rod part of one of the antennas is coupled to the closed one of the rod in another of the antennas.

13. The multiple stage antenna as claimed in claim 12, wherein the rods of the antennas include at least one shape comprising an elongated rod, a coil, a flat plate, and a board shape bent in a zigzag manner.

14. The multiple stage antenna as claimed in claim 12, comprising at least one additional rod connected in series to the rod of one of the antennas.

15. The multiple stage antenna as claimed in claim 14, wherein one of the rods has at least one shape comprising an elongated rod, a coil, a flat plate, and a board shape bent in a zigzag manner.

16. The multiple stage antenna as claimed in claim 12, wherein the rods are connected in series, and one of the rods has connection terminals for extracting different signals of a predetermined frequency band at a position where the rods are connected with each other.

17. A two stage antenna for a wireless communication, comprising:

a cylindrical first holder with a closed end and a closed side portion;

a cylindrical second holder with a closed end and a closed side portion;

a first rod with one end connected to the closed end of the first holder, so that the first rod is electrically connected with the first holder;

a second rod with one end connected to the closed end of the second holder, so that the second rod is electrically connected with the second holder; and at least one additional rod is connected in series between the first rod and the second rod.

18. The antenna as claimed in claim 17, wherein the at least one additional rod has at least one shape comprising an elongated rod, a coil, a flat plate, and a board shape bent in a zigzag manner.

19. A composite antenna for a wireless communication, comprising:

a main wireless communication antenna including a cylindrical holder with a closed end and a closed side portion and a rod with one end connected to the closed one end of the holder;

an auxiliary wireless communication antenna including a cylindrical holder with a closed end and a closed side portion; and a rod with one end connected to the closed end of the holder; and a flat plate connection part with one face connected in series to the rod of the main wireless communication antenna and another face of the flat plate connection part is connected to a connection rod and wherein;

rods of the respective wireless communication antennas are connected in series to the one face of the connection rod, and are connected to the connection rod in parallel with the main wireless communication antenna.

20. The composite antenna as claimed in claim 19, wherein at least one of the wireless communication antennas is connected to the connection rod at a same face as a face to which the main wireless communication antenna is connected.

21. The composite antenna as claimed in claim 19, wherein at least one of the wireless communication antennas is connected to the connection rod at face opposite to a face to which the main wireless communication antenna is connected.

22. The composite antenna as claimed in claim 19, further comprising another rod connected in series to one end of the connection rod.

23. The composite antenna as claimed in claim 22, wherein the another rod of the connection are connected in series with each other, and connection terminals for extracting different signals of a predetermined frequency band are formed at a position where the auxiliary rod is connected with each other.

24. The composite antenna as claimed in claim 19, wherein the rod of the main wireless communication antenna is coupled to an outer face of the closed end of the holder.

25. The composite antenna as claimed in claim 19, wherein the rod of at least one auxiliary wireless communication antenna is connected to an outer face of the closed end of the holder thereof.

* * * * *